United States Patent [19]

Dobler et al.

[11] 4,266,273

[45] May 5, 1981

[54] SYSTEM FOR CONTROLLING TRACK-BOUND VEHICLES FORMING A TRAIN

[75] Inventors: Karl-Ulrich Dobler, Waiblingen; Sigurd Mura, Leonberg; Erhard Kraft, Hemmingen, all of Fed. Rep. of Germany

[73] Assignee: International Standard Electric Corporation, New York, N.Y.

[21] Appl. No.: 40,611

[22] Filed: May 21, 1979

[30] Foreign Application Priority Data

Jun. 2, 1978 [DE] Fed. Rep. of Germany ..... 2824168

[51] Int. Cl.[3] ..... B61L 27/00; G06F 15/50

[52] U.S. Cl. ..... 364/426; 364/424; 364/436; 364/119; 246/3; 246/6

[58] Field of Search ..... 364/426, 424, 436, 119; 246/5, 3, 4, 6

[56] References Cited

U.S. PATENT DOCUMENTS

| | | | |
|---|---|---|---|
| 3,268,727 | 8/1966 | Shepard | 246/5 X |
| 3,636,331 | 1/1972 | Amrehn | 364/119 X |
| 3,786,433 | 1/1974 | Notley et al. | 364/119 X |
| 4,005,838 | 2/1977 | Grundy | 364/426 X |
| 4,023,753 | 5/1977 | Dobler | 364/436 X |
| 4,041,470 | 8/1977 | Slane et al. | 364/426 |
| 4,093,161 | 6/1978 | Auer, Jr. | 364/436 X |
| 4,093,162 | 6/1978 | Takaoka et al. | 364/426 X |
| 4,133,027 | 1/1979 | Hogan | 364/119 |
| 4,179,739 | 12/1979 | Virnot | 246/3 X |
| 4,184,203 | 1/1980 | Skarvada | 364/565 X |

*Primary Examiner*—Edward J. Wise

*Attorney, Agent, or Firm*—John T. O'Halloran; Alfred C. Hill

[57] ABSTRACT

A system is disclosed for controlling vehicles equipped with computer systems from a center of a rapid transit system. If at least two vehicles equipped with computer systems form a train, and the computer system of the vehicle controlling the train fails, the control of the train can be shifted onto the computer system of another vehicle. Therefore, the individual on-board computers need not be fully redundant.

12 Claims, 3 Drawing Figures

SYSTEM FOR CONTROLLING TRACK-BOUND VEHICLES FORMING A TRAIN

BACKGROUND OF THE INVENTION

The present invention relates to a system for controlling track-bound vehicles at least some of which are equipped as guide vehicles having onboard computer systems, transmitting and receiving equipment and position-determining equipment and are capable of exchanging data messages with a fixed control station having a computer system.

U.S. Pat. No. 4,015,804 issued Apr. 5, 1977, assigned to the same assignee as the present application, whose disclosure is incorporated herein by reference discloses a hierarchically organized, demand-controlled vehicle control system in which a plurality of track-bound vehicles is controlled from individual operations control centers. The individual vehicles carry on-board control equipment which cyclically exchange data with the operations control center, their fixed control station.

U.S. Pat. No. 4,198,678, issued Apr. 15, 1980, assigned to the same assignee as the present application, whose disclosure is incorporated herein by reference, proposes to use for the on-board control equipment computer systems each consisting of two computers which compare the results created by them and thus detect processing errors.

Since a failure of one of these computers still results in a failure of a vehicle and, consequently, in section blocking, the same application also proposes to hold a standby computer or a pair of standby computers ready for use when a computer or the whole computer system has failed.

However, this solution is relatively expensive because up to 4 computers are needed. Also, considerable space is required for the on-board computer systems on the vehicles. These disadvantages remain even if, in order to eliminate the need for emergency braking, in the event of a failure of a computer, two complete two-computer systems are selected alternately from the fixed control station to process the data messages and control the propulsion and braking equipment, as proposed in U.S. Pat. No. 4,181,945, issued Jan. 1, 1980, assigned to the same assignee as the present application, whose disclosure is incorporated herein by reference.

Particularly the handling of crowds of people during the rush hours, which requires high system availability, necessitates the provision of a large number of vehicles equipped with two expensive two-computer systems each. During the remainder of the day, a large part of these vehicles remains unused.

SUMMARY OF THE INVENTION

The object of the invention is to provide a system for controlling track-bound vehicles which eliminates the need to equip the vehicles with a standby computer or a standby computer system without reducing safety and reliability of operation and makes it possible to incorporate non-equipped vehicles (i.e. vehicles having no control equipment) into the overall system to handle rush hour traffic.

The invention thus allows individual vehicles to be connected to form trains in which unequipped, low-cost vehicles may be incorporated as well. In addition, the provision of several guide vehicles in a train offers the possibility of using guide vehicles with only one two-computer system, which provides safety of operation without increasing the probability of traffic disturbances, because in the event of a malfunction in the computer system of the activated guide vehicle, another guide vehicle can be activated.

With the aid of the invention, a traffic system can thus be implemented which operates economically both during quiet times, e.g. during the night hours, and during busy times, and meets the passengers' needs for a sufficient number of seats and for short waiting times in the best manner possible.

Such a traffic system could comprise a major number of guide vehicles (Type A) with one two-computer system, which run only as a train, and a small number of guide vehicles (Type B) with two two-computer systems, which can be used both in a train and, e.g., during quiet times, as independent vehicles. In addition to the guide vehicles, there could be a large number of non-equipped vehicles which, together with several Type-A guide vehicles or one Type-B vehicle, would run as a train and increase the number of seats available during the rush hours.

A further development of the vehicle control system according to the invention is that the disconnection of the control lines running to the propulsion and braking systems and the initiation of an emergency brake application ensure that in the event of a malfunction in the computer system or in the absence of data messages from the fixed control station, the delivery of incorrect control commands to the propulsion and braking systems will be prevented, and that the vehicle will be brought to a stop as soon as possible.

Another development of the system according to the invention permits the cancellation of an initiated emergency brake application by the computer system of another guide vehicle. This makes it possible to activate another guide vehicle from the fixed control station in the event of a malfunction, and to continue the control of the train via this vehicle. As a result of the brake application time of the emergency braking system, the emergency brake application, initiated for a short time, will hardly be perceived by the passengers.

A further development of the system according to the invention makes it possible to activate another guide vehicle even if it is not the on-board computer system of the hitherto activated guide vehicle which is defective but the transmitting equipment of this vehicle.

A further development of the system according to the invention allows the position of the head of the train to be accurately determined in the fixed control station at any time even if the data messages and, thus, the distance measurement results stem from guide vehicles located different distances from the head of the train.

Errors may occur in a computer system not only when the computer system is active but also when it is inactive. For reasons of system availability it is desirable to detect such errors occurring in the inactive condition as soon as possible. The further development of the invention shows one way of accomplishing this.

Another way is disclosed in the development of the system according to the invention for the fixed control station to receive and check data messages from inactive computer systems.

BRIEF DESCRIPTION OF THE DRAWINGS

An embodiment of the system according to the invention will now be described in detail with reference to the accompanying drawing, in which.

DETAILED DESCRIPTION OF THE INVENTION

Figure 1:
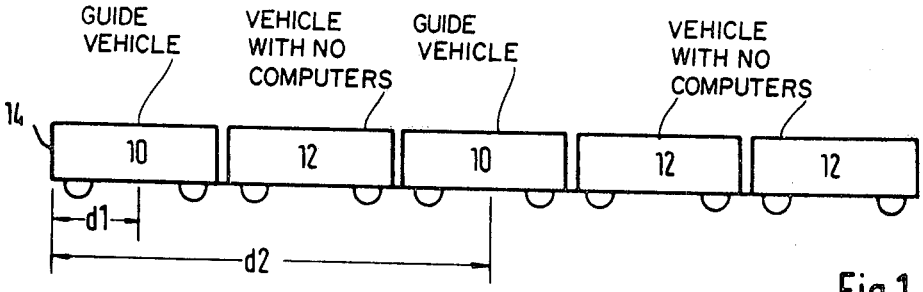
FIG. 1 shows a train with two guide vehicles.

FIG. 1 shows an example of how a train may be composed of guide vehicles 10 and of vehicles 12 not equipped with computer systems. The distances d1 and d2 between the guide vehicles and the head 14 of the train are communicated to the fixed control station after the train has been assembled. It is purely by chance that the head of the train is formed in the figure by a guide vehicle; this is not imperative.

Figure 2:
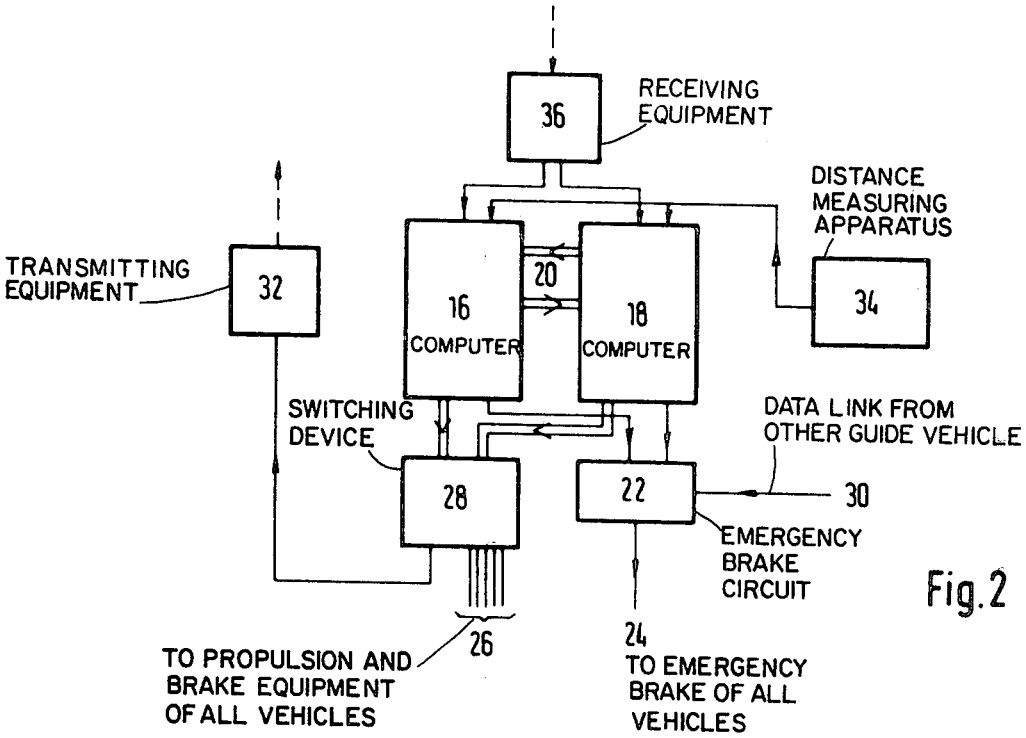
FIG. 2 shows schematically the guide vehicle equipment.

FIG. 2 shows an on-board computer system with two computers 16 and 18 substantially as disclosed in the above-cited U.S. Pat. No. 4,198,678. These are synchronized by a common interrupt control and interconnected by two data buses 20. Over these data buses, the computers exchange their results if the computer system is in an operable condition. After this, each computer compares its own result with the result of the other. If both computers have determined that the results agree, each of them provides a "life signal" to an emergency brake circuit 22, which, in response thereto delays the application of the emergency brake 24 by a certain time. If no additional life signals are received from both computers during that time, emergency braking will be initiated. The initiation of emergency braking entails the disconnection of all major vehicle control lines 26 to the propulsion and braking equipment of all the vehicles from the computer outputs by means of a switching device 28. This switching device 28 cannot connect these control lines 26 to the computer outputs again until the computer system is reactivated by the fixed control station. However, after the computer system of another vehicle has been activated from the fixed control station, life signals of the last activated computer system can be fed to the emergency brake circuit of the hitherto active guide vehicle over a data link 30 (emergency brake control line), thus cancelling the emergency brake application. The activation of the other guide vehicle by the fixed control station is normally affected in response to non-appearance of, or an error in, the data message delivered by a transmitting equipment 32 of the hitherto active guide vehicle, by transmitting a special activating signal.

A distance-measuring apparatus 34 on each guide vehicle determines the distance travelled from a fixed reference point by means of a noncontacting or wheel-revolution-evaluation distance meter. This distance measurement is additionally corrected with the aid of track marks, such as transpositions of continuous track conductors. In continuous track conductor systems, for example, the locations of the track marks are derived from the phase of the data-message signal received by a receiving equipment 36 or from a track-mark detector (not shown). The position of the guide vehicle is communicated to the fixed control station within the data messages.

Figure 3:
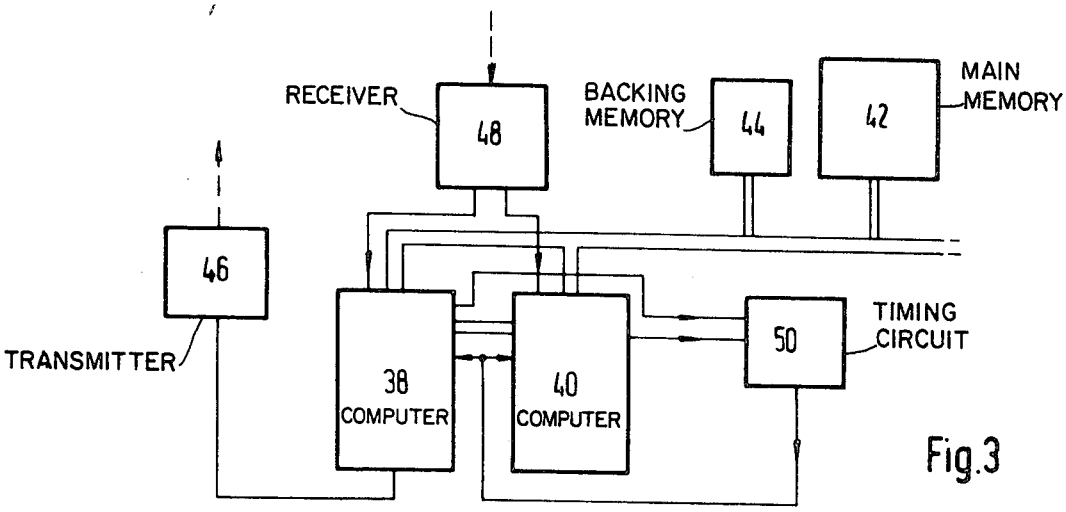
FIG. 3 shows schematically that equipment of the fixed control station which forms part of the system according to the invention.

FIG. 3 shows a computer system 38, 40 which fulfills the control function of the fixed control station. This computer system is usually connected to a standby computer system and to a higher-level operations control center as disclosed in the above-cited U.S. Pat. No. 4,015,804. Associated with the computer system are a large-capacity main memory 42 and a backing memory 44. While the main memory holds the greater part of all vehicle and line data, the backing memory serves to store the distance between each of the guide vehicles and the head of their train. To determine the position of the head of a train, the distance between the respective guide vehicle and the head of the train is added to the measured distance value communicated within a data message.

FIG. 3 also shows a transmitter 46 and a receiver 48 for the exchange of data messages, and a timing circuit 50. This timing circuit is fed with check signals from both computers when an incoming data message has passed through the address-recognition and checking portions of the computers and must thus be considered valid. If the timing circuit receives no check signal within a given period of time, it will cause the computer system to transmit its data messages with the address of another guide vehicle together with the activating signal, thus activating this other guide vehicle. If a train has stopped at a station and the computer system at the fixed control station is informed that the running speed of the train is "zero", the computer system will change the address of the guide vehicle automatically. This results in another guide vehicle being activated and makes it possible to check the latter for proper operation without any previous failure of the hitherto active guide vehicle being necessary.

The fixed control station is also capable of transmitting data messages to the guide vehicles without activating the latter. This is done, for example, if a vehicle is to be checked for its proper condition or if information for the passengers is to be transmitted. In that case, the data messages do not contain the activating signal.

In the opposite direction, the guide vehicles, after being called by the fixed control station, can transmit to this control station data messages which may contain status reports, measured values (position or speed) or passenger requests (request stop), for example, and, in addition, enable the fixed control station to check the computer system and the transmitter of the respective vehicle for proper operation.

While we have described above the principles of our invention in connection with specific apparatus it is to be clearly understood that this description is made only by way of example and not as a limitation to the scope of our invention as set forth in the objects thereof and in the accompanying claims.

What is claimed is:

1. A system for controlling track-bound vehicles comprising:

a train of N track-bound vehicles including at least two guide vehicles each having an on-board computer system and switching device, transmitting and receiving equipment connected to said on-board computer system, position-determining equipment connected to said on-board computer system, propulsion and braking equipment connected to said switching device, where N is an integer greater than two, and N–2 vehicles of said train each having a propulsion and braking equipment connected to said switching device of an activated one of said on-board computer system, said on-board computer system of each of said two guide vehicles delivering control commands to said propulsion and braking equipment of said N vehicles through its associated one of said switching device when activated; and a fixed control station having a control computer system capable of exchanging data messages with said on-board computer system of each of said two guide vehicles, said control computer system activating one of said two on-board computer systems to connect said control commands thereof through its associated one of said switching devices.

2. A system according to claim 1, wherein each of said on-board computer systems includes at least two computers operating independently of each other to process information required for safe running of said train contained in said data messages received from said control computer system and to compare the output of each of said two computers resulting from said processing therein;

each of said two guide vehicles further includes an emergency brake circuit coupled to each of the associated one of said two computers;

each of said switching devices responds to different outputs from each of the associated one of said two computers to block said control commands from the associated one of said two on-board computer systems to said propulsion and braking equipment; and each of said emergency brake circuits initiating emergency braking when said different outputs occur.

3. A system according to claim 2, wherein said control computer system receives information that said emergency braking has been initiated in one of said two guide vehicles and activates said on-board computer system of the other of said two guide vehicles, and a data link interconnecting said two guide vehicles to transmit a signal from said other of said two guide vehicles to said one of said guide vehicles to cancel said emergency braking in said one of said two guide vehicles.

4. A system according to claim 3, wherein said signal on said data link is a continuous signal transmitted to each of said N vehicles to override deadman switches therein.

5. A system according to claims 1, 2, 3 or 4, wherein said control station includes a timing circuit coupled to said control computer system for monitoring said data messages received by said control computer system, said timing circuit causing said control computer system to activate the inactive one of said on-board computer systems when a valid data message is not received from the activated one of said on-board computer systems in a predetermined period of time.

6. A system according to claim 5, wherein said control station further includes a backing memory coupled to said control computer system into which is entered the distance between each of said two guide vehicles and the front of said train after assembly of said train, said position-determining equipment of each of said two guide vehicles continuously measures the distance travelled by said train, and said control computer determines the position of the front of said train from the distance measurement of said position-determining equipment of said activated one of said two on-board computer systems and from the distance between said activated one of said on-board computer systems and the front of said train stored in said backing memory.

7. A system according to claim 6, wherein said control computer system activates the inactive one of said two on-board computer systems at predetermined times even when the activated one of said two on-board computer systems is operating properly.

8. A system according to claim 7, wherein said control computer system can call upon an inactive one of said two on-board computer systems to deliver data messages without completely activating said inactive one of said two on-board computer systems.

9. A system according to claim 6, wherein said control computer system can call upon an inactive one of said two on-board computer systems to deliver data messages without completely activating said inactive one of said two on-board computer system.

10. A system according to claim 5, wherein said control computer system activates the inactive one of said two on-board computer systems at predetermined times even when the activated one of said two on-board computer systems is operating properly.

11. A system according to claim 10, wherein said control computer system can call upon an inactive one of said two on-board computer systems to deliver data messages without completely activating said inactive one of said two on-board computer system.

12. A system according to claim 5, wherein said control computer system can call upon an inactive one of said two on-board computer systems to deliver data messages without completely activating said inactive one of said two on-board computer system.

* * * * *